US006035659A

United States Patent [19]

Fernandez

[11] Patent Number: 6,035,659

[45] Date of Patent: Mar. 14, 2000

[54] SANITARY BEVERAGE COOLER

[76] Inventor: Luis Fernandez, 8251 NW. 198th St., Hialeah, Fla. 33015

[21] Appl. No.: 09/157,027

[22] Filed: Sep. 18, 1998

[51] Int. Cl.[7] ..... F25D 3/08

[52] U.S. Cl. ..... 62/457.4; 62/530; 62/457.3

[58] Field of Search ..... 62/457.4, 457.3, 62/530

[56] References Cited

U.S. PATENT DOCUMENTS

| | | | |
|---|---|---|---|
| 117,712 | 8/1871 | Wright . | |
| 296,432 | 8/1884 | Moebius . | |
| 1,009,406 | 11/1911 | Graham . | |
| 1,858,728 | 5/1932 | Creighton | 62/457.3 |
| 1,954,369 | 4/1934 | Solomon . | |
| 2,370,931 | 3/1945 | Bogin et al. . | |
| 2,838,916 | 7/1958 | Sola | 62/457.3 |
| 4,338,795 | 7/1982 | House . | |
| 5,009,083 | 4/1991 | Spinos et al. . | |
| 5,031,831 | 7/1991 | Williams, III . | |
| 5,048,305 | 9/1991 | Taub . | |
| 5,129,238 | 7/1992 | Schwartz et al. . | |
| 5,201,194 | 4/1993 | Flynn, Jr. et al. | 62/457.3 |
| 5,269,156 | 12/1993 | Van De Velde et al. | 62/457.4 |
| 5,284,028 | 2/1994 | Stuhmer | 62/457.3 |
| 5,288,019 | 2/1994 | Gorochow . | |
| 5,357,761 | 10/1994 | Schauer . | |
| 5,454,497 | 10/1995 | Kettelson | 224/148 |
| 5,507,156 | 4/1996 | Redmon . | |
| 5,590,542 | 1/1997 | Wang . | |
| 5,597,087 | 1/1997 | Vinarsky . | |
| 5,609,039 | 3/1997 | Green et al. . | |
| 5,653,124 | 8/1997 | Weber . | |
| 5,845,499 | 12/1998 | Montesanto | 62/48.1 |
| 5,845,514 | 12/1998 | Clarke et al. | 62/373 |

*Primary Examiner*—Henry Bennett
*Assistant Examiner*—Mark Shulman
*Attorney, Agent, or Firm*—Lott & Friedland, PA

[57] ABSTRACT

A sanitary beverage cooler. This invention provides for a sanitary beverage cooler which is affixed to the open top of a beverage-holding container such as a can or bottle. The sanitary beverage cooler is filled with a cooling substance such as a plurality of ice cubes. As the beverage passes through the opening in the beverage-holding container, either by tilting or by use of a straw, and into the orifice defined by the cylindrical receptacle of the beverage cooler, the beverage becomes cooled by the cooling substance which is contained within the beverage cooler. The user is thereby able to affix the beverage cooler to a beverage-holding container containing a warm beverage, and drink the beverage contained therein after it has been cooled by cooling substance without the possibility of the beverage being diluted by continuous and prolonged contact with the cooling substance.

11 Claims, 3 Drawing Sheets

SANITARY BEVERAGE COOLER

TECHNICAL FIELD

This invention relates generally to a beverage cooler and in particular to a sanitary beverage cooler comprised of a cylindrical receptacle capable of affixing to the open end of a beverage-holding container whereby the cylindrical receptacle contains a cooling substance such as ice which cools the beverage before it enters the user's mouth.

BACKGROUND OF THE INVENTION

In the beverage and refrigeration industries, a number of different methods are utilized for keeping beverages cool without diluting or watering down the beverage. For example, cylindrical foam receptacles, or "coozies", may be used to maintain the temperature of a bottle or can containing a beverage. Coolers and ice buckets are also available. In the former example however, the foam receptacle cannot maintain the temperature of the beverage for long and unless the beverage is consumed quickly, the temperature of the beverage tends to rise, and the user finds himself drinking a luke-warm beverage. In the latter examples, both coolers and ice buckets are too large and bulky to use in portable situations.

Yet another attempt at maintaining the temperature of the beverage is to insert a cooling substance other than ice into the bottle or can containing the beverage. The cooling substance can be enclosed in a shaped packet which is frozen before it is inserted into the beverage-holding container. However, it would be a time-consuming task to insert a packet containing a cooling substance into each can or bottle. It may be difficult or impossible to find such an insert that would fit into the small opening in the can or bottle.

Other beverage-cooling devices are thermos-type containers, in which a beverage bottle or can is inserted into the thermos-like container, which maintains the temperature of the beverage. A straw can be inserted into the container to allow the user to withdraw the cooled beverage. However, it would require a great deal of time and effort for a vendor at a stadium, for example, to insert each can of soda or beer in one of the thermos-like containers. Of course, simply pouring the beverage into a cup filled with ice cubes does not solve the dilemma as this leads back to the original problem of dilution of the beverage upon the melting of the ice.

Previous attempts have been made to design improved beverage-cooling devices, certain features of which are generally described in U.S. Pat. No. 5,653,124 to Weber; U.S. Pat. No. 5,609,039 to Green et al.; U.S. Pat. No. 5,597,087 to Vinarsky; U.S. Pat. No. 5,590,542 to Wang; U.S. Pat. No. 5,357,761 to Schauer; U.S. Pat. No. 5,507,156 to Redmon; U.S. Pat. No. 5,288,019 to Gorochow; U.S. Pat. No. 5,129,238 to Schwartz et al.; U.S. Pat. No. 5,048,305 to Taub; U.S. Pat. No. 5,031,831 to Williams III; U.S. Pat. No. 5,009,083 to Spinos et al.; U.S. Pat. No. 4,338,795 to House, Jr.; U.S. Pat. No. 2,370,931 to Bogin et al.; U.S. Pat. No. 1,954,369 to Solomon; U.S. Pat. No. 1,009,406 to Graham; U.S. Pat. No. 0,296,432 to Moebius; and U.S. Pat. No. 0,117,712 to Wright, all of which are incorporated herein by reference.

U.S. Pat. No. 5,653,124 to Weber (the '124 patent) describes a refrigerated insulated beverage container system comprised of an insulated stein featuring a sleeve into which a can may be inserted into and an optional insulating vessel into which a beverage can be poured directly into. A handle and lid are provided as is a portable reusable refrigerant disk that fits into the cavity at the bottom of the stein.

U.S. Pat. No. 5,609,039 to Green et al. (the '039 patent) describes a combination drinking bottle and internal cooling cartridge wherein the cartridge has longitudinal protrusions separated by longitudinally extending concave surfaces. A refrigerant is sealed between the space created by the cartridge's side, top and bottom surfaces. The cartridge fits into the drinking bottle as shown in FIG. 5(*a*), and a straw can be inserted to extract the beverage that is to be cooled as shown in FIG. 6(*c*).

U.S. Pat. No. 5,597,087 to Vinarsky (the '087 patent) describes a liquid-tight sports bottle with a thermal chiller pack inserted into the sports bottle as seen in FIG. 1. The chiller pack contains a solution that can be cooled to freezer temperatures to keep the liquid contained therein chilled.

U.S. Pat. No. 5,590,542 to Wang (the '542 patent) describes a canteen capable of holding a first drink which is cooled by a frozen second drink contained in a capsule which is removably held in a bracket formed on the underside of the canteen's cover. The first drink may be consumed by a straw, while the capsule containing the second drink may be removed, and its contents, now melted, may be drunk through a neck formed in the upper end of the capsule.

U.S. Pat. No. 5,357,761 to Schauer (the '761 patent) describes a thermos insert for beverage containers. The insert is comprised of a molded polyethylene hollow tube filled with a refrigerant material which cools the beverage inside the container.

U.S. Pat. No. 5,507,156 to Redmon (the '156 patent) describes a cooling device which utilizes an ice substitute in a shaped container which can be inserted into a sports bottle and is retained in place by a straw as shown in FIG. 1. The cooling device contains openings at its bottom to allow the fluid to be drawn through the openings after it has flowed past the cooling device.

U.S. Pat. No. 5,288,019 to Gorochow (the '019 patent) describes a drinking device which acts as a heat exchanger, drawing heat from a hot liquid, thereby allowing the user to consume a cooled beverage. The device, as shown in FIG. 3, includes flexible inner and outer tubes with an air space between the tubes that is filled with a thermally conductive solid which forms the heat exchanger portion. This portion remains unsubmerged in the beverage, thereby cooling only the liquid drawn up by the user through the extended straw-like portion of the inner tube.

U.S. Pat. No. 5,129,238 to Schwartz et al. (the '238 patent) describes a drinking container having a cap member integral with a freezable insert containing an aqueous solution with a freezing point below that of water. The frozen aqueous solution can cool a liquid placed within the container.

U.S. Pat. No. 5,048,305 to Taub (the '305 patent) describes a cooler assembly which stores ice-cooled can beverages and is comprised of an ice-cooled storage vessel which is suspended within the assembly's housing. The housing is formed by a series of vertically disposed panel-like spacers which prevent contact of the cans with the water formed during the melting of the ice.

U.S. Pat. No. 5,031,831 to Williams, III (the '831 patent) describes a device for cooling potable liquids by inserting a continuous capillary tube inside of a cooling chamber. The liquid enters the bottom of the tube and then enters the five inch long cooling chamber allowing the user to draw the liquid, now cooled, into his mouth.

U.S. Pat. No. 5,009,083 to Spinos et al. (the '083 patent) describes a beverage cooler having an inner and outer container defining an annular chamber which holds a beverage. The inner container contains a refrigerant which cools the body of the beverage and further cools the beverage as it is withdrawn through a drinking straw passageway located within the inner container as shown in FIG. 1.

U.S. Pat. No. 4,338,795 to House, Jr. (the '795 patent) shows an insulated cooling receptacle for a beverage bottle comprised of an insulating base portion and a bottle-cooling cap portion filled with a freezable substance. The cap portion is removable to allow for the insertion and removal of the bottle.

U.S. Pat. No. 2,370,931 to Bogin et al. (the '931 patent) describes a combined drink cooler and sipper comprised of a closed container containing refrigerant material integral with a sipper tube. The container is placed in a glass containing a beverage to be cooled and is supported on the rim of a glass by a hook-like projection upon the sipper tube.

U.S. Pat. No. 1,954,369 to Solomon (the '369 patent) describes a beverage shaker resembling a traditional cocktail shaker having a beverage container to hold the beverage to be cooled and an ice chamber which is inserted into the container and suspended within the beverage container when the cap is secured as shown in FIG. 1. After the beverage is poured into the beverage container, the user vigorously shakes the container, agitating the beverage, and bringing the beverage into contact with the outer wall of the ice-filled ice chamber thereby cooling the beverage.

U.S. Pat. No. 1,009,406 to Graham (the '406 patent) describes a holder for iced beverages comprised of an outer cup-shaped receptacle A open at the top and an inner receptacle of less depth than the outer receptacle B and sharing the same opening at the top. The inner receptacle together with the outer, forms an interior chamber C which receives the beverage to be cooled. After the inner chamber is removed to fill the interior chamber C with the beverage, it is replaced and filled with ice to cool the beverage. The inner chamber is removed a second time in order for the user to consume the cooled beverage.

U.S. Pat. No. 0,296,432 to Moebius (the '432 patent) describes a refrigerator for cooling the contents of a liquid comprised of a fibrous covering to be passed over a bottle or other liquid-holding container wherein part of the covering extends into the liquid which is absorbed by the fibers and is evaporated, thereby cooling the contents of the container.

U.S. Pat. No. 0,117,712 to Wright (the '712 patent) describes an ice-vessel comprised of sheet metal which is inserted into an opening in a counter or bar and remains flush with it. Integral with and extending through the center of the ice-vessel is a cylindrical bottle holder with perforations therein to hold a bottle whose contents are to be cooled. The invention provides for a way to insert and remove bottles of liquor into an ice-filled cooler without the necessity removing or disturbing the ice.

However, none of the above patents disclose a simple and effective way to cool beverages without diluting the beverage. Consequently, there is a need in the art for a sanitary beverage cooler which can be carried virtually anywhere and can be adapted to engage with the opening of different sizes of beverage-holding containers, such as bottles or cans. There is a further need in the art for a sanitary beverage cooler which utilizes a relatively small amount of cooling substance to cool a beverage as it exits the bottle or can, without diluting the beverage. The present invention provides these needs.

SUMMARY OF THE INVENTION

The present invention solves significant problems in the art by providing a sanitary beverage cooler which can easily fit into one's pocket. Beer or soda vendors at ballpark stadiums can replace their heavy tubs of ice with light trays of beverage cans, each with the sanitary beverage cooler of the present invention affixed to its top, and maintain the temperature of the cold beer or soda without being burdened by the weight of excess ice. The present invention is adaptable for use with a variety of different size beverage-holding containers. Its ease of use and effectiveness are what make it unique.

An object of the present invention is to provide a sanitary beverage cooler that requires a small amount of cooling substance to be effective. As only that portion of the beverage that exits the beverage-holding container needs to be cooled rather than the entire contents of the beverage-holding container, only a small amount of cooling substance placed within the beverage cooler is sufficient to cool the beverage as it exits the beverage-holding container.

Another object of the present invention is to provide a sanitary beverage cooler that can be disposable and can be formed in a variety of shapes and sizes in order to fit the tops of various sizes of cans, bottles, or other beverage-holding containers.

Generally, the present invention provides a sanitary beverage cooler comprising a cylindrical receptacle which defines an orifice for retaining a cooling substance, wherein the receptacle has a first end defining a first aperture having a first diameter, an affixing end defining a second aperture having a second diameter, a middle portion, inner and outer sides, and means to affix said receptacle to an open end of a beverage-holding container.

In its preferred embodiment, the sanitary beverage cooler described above provides an affixing means comprised of a protruding lip projecting circularly inward from the inner side of the affixing end wherein the lip is in continuous abutting engagement with the open end of the beverage-holding container.

In an alternate form of the sanitary beverage cooler, the cooling substance is a plurality of ice cubes.

An alternate embodiment of the present invention provides a sanitary beverage cooler as described above wherein the first diameter is greater than the second diameter thereby increasing the size of the orifice to allow for a greater amount of the cooling substance to be retained within said cylindrical receptacle.

In an alternate embodiment of the present invention the first end has the same diameter as the affixing end.

In an alternate form of the present invention, the cylindrical receptacle is formed of plastic.

An alternate embodiment of the present invention provides for a sanitary beverage cooler wherein the second diameter is of sufficient dimensions to affix to the open end of a beverage-holding can.

In an alternate form, the second diameter is of sufficient dimensions to affix to the open end of a beverage-holding bottle.

In an alternate embodiment, the sanitary beverage cooler is disposable.

The present invention also provides a method for cooling a beverage as the beverage exits a beverage-holding container without diluting the beverage while using the sanitary beverage cooler of the present invention. This steps of this method are comprised of opening the beverage-holding container, affixing the sanitary beverage cooler to an open end of the beverage-holding container, providing a means for the beverage to exit the beverage-holding container, and providing a means for allowing the beverage to pass through a cooling substance which is retained within the cylindrical receptacle prior to the beverage entering a user's mouth.

These and other objects, features, and advantages of the present invention may be better understood and appreciated from the following detailed description of the embodiments thereof, selected for purposes of illustration and shown in the accompanying drawings.

DETAILED DESCRIPTION

Figure 1:
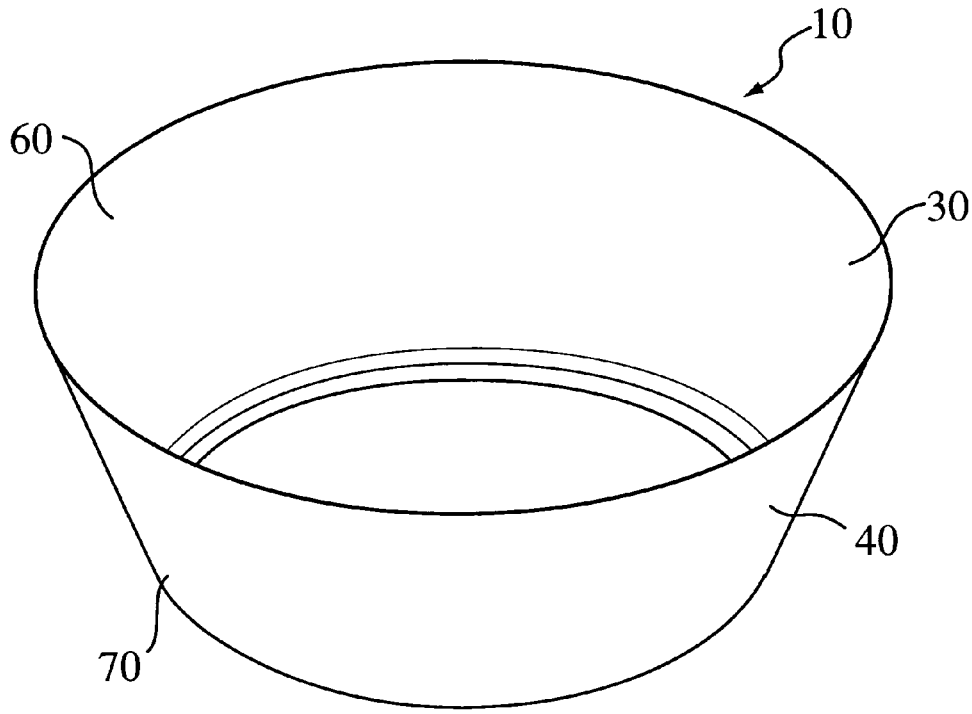
FIG. 1 shows a perspective view of the sanitary beverage cooler 10 with its first end 30, middle portion 40, inner side 60 and outer side 70.
Figure 2:
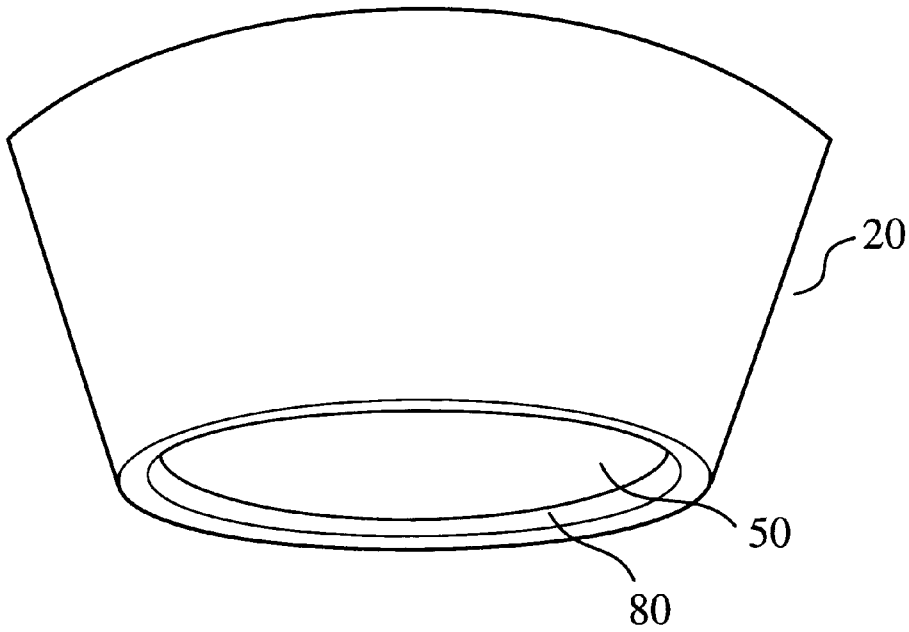
FIG. 2 shows a perspective view of the sanitary beverage cooler 10 from underneath the cylindrical receptacle 20 showing the affixing end 50 and protruding lip 80.
Figure 3:
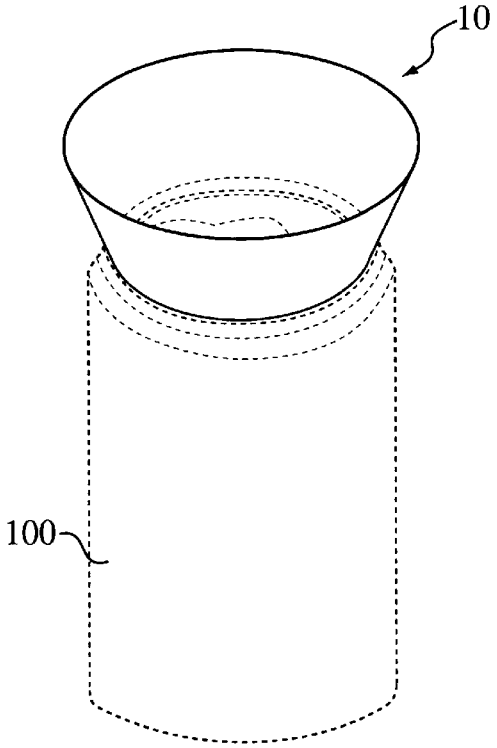
FIG. 3 shows a side view of the sanitary beverage cooler 10 affixed to a beverage can 100.
Figure 4:
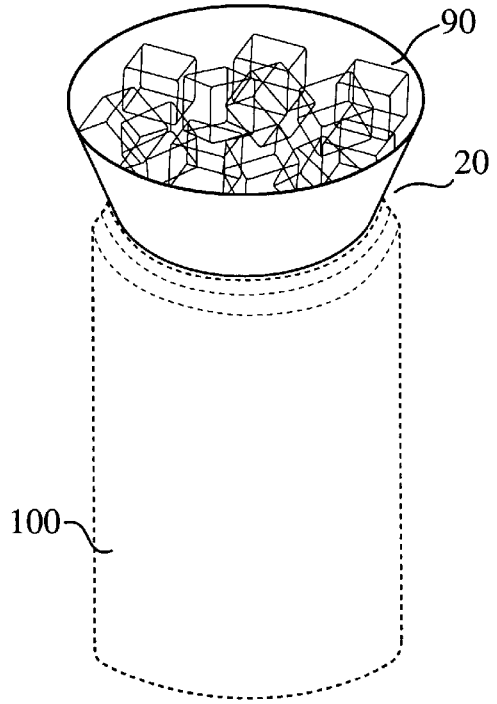
FIG. 4 shows the sanitary beverage cooler 10 affixed to a beverage can 100 where a cooling substance 90 fills the cylindrical receptacle 20 of the beverage cooler 10.

Referring initially to FIG. 1 of the drawings, in which like numerals indicate like elements throughout the several views, in a preferred embodiment, the sanitary beverage cooler 10 of the present invention is generally comprised of a cylindrical receptacle 20. The receptacle 20 has a middle portion 40, a first end 30 and an affixing end 50. The receptacle 20 also comprises an inner side 60 and an outer side 70. In the primary embodiment, the receptacle 20 is somewhat conically-shaped and is wide enough to contain a cooling substance 90 such as ice. The second end 50 defines an aperture with a diameter of nearly the exact size as that of the end of a beverage-holding container 100, such as a can or a bottle.

In the embodiment where the cooling substance 90 is a plurality of ice cubes, the amount of ice cubes used to fill the receptacle 20 should be enough to cool the beverage which exists within the beverage-holding container 100, yet not enough to spill out of the receptacle 20 as it is tilted to allow the user to drink the cooled beverage exiting the open end of the beverage-holding container after it has passed through the ice cubes. Further, the size of the ice cubes must be sufficiently large as to prevent the ice cubes from entering the opening in the top of the beverage-holding container. Water can also be frozen to create a block of ice, which can be inserted into the orifice defined by the receptacle 20 of the beverage cooler 10.

Figure 5:
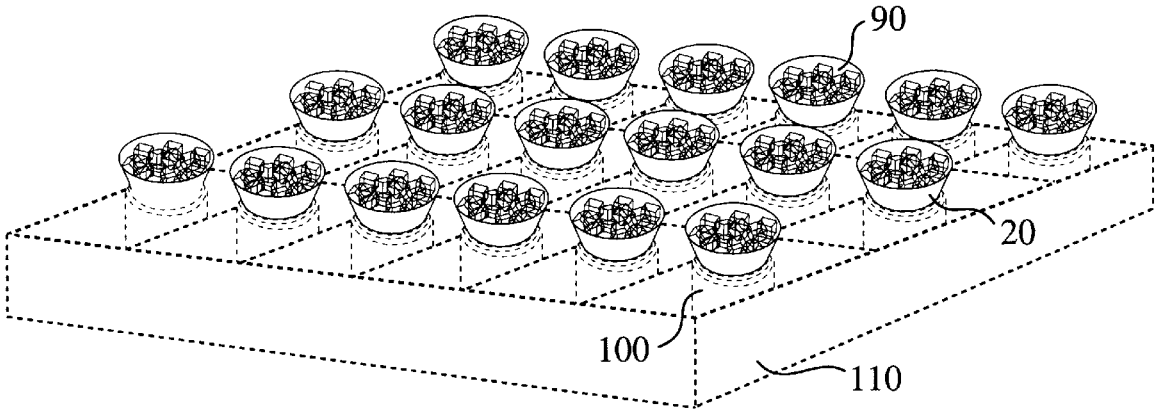
FIG. 5 shows a tray 110 holding a plurality of beverage cans 100, each with the sanitary beverage cooler 10 affixed to the beverage can 100, where a cooling substance 90 fills the cylindrical receptacle 20.

As shown in FIG. 5, a light tray 110 of beverage-holding containers 100, such as cans, each with the sanitary beverage cooler 10 affixed to the top of the beverage can, where a cooling substance fills the cylindrical receptacle 20 of each sanitary beverage cooler 10, can replace a beer or soda vendor's heavy tub of ice. The beverage cooler 10 maintains the temperature of the cold beer or soda without the weight of excess ice making it easier and less burdensome for a ballpark or stadium vendor to carry.

In the preferred embodiment, an affixing means comprised of a protruding lip 80 projects circularly inward from the inner side 60 of the affixing end 50 of the receptacle 20. The protruding lip 80 engages the open end of a beverage-holding container 100 allowing the user to lift both the disposable beverage cooler 10 and the beverage-holding container 100 by grasping only the disposable beverage cooler 10 which remains engaged to the beverage-holding container 100 via the interlocking of the protruding lip 80 with the open end of the beverage-holding container.

In the instance that the beverage-holding container 100 is a can, the can is first opened; the sanitary beverage cooler 10 is then secured to the open end of the can after which the cooling substance 90 is placed within the disposable beverage cooler 10. As the opening in the top of a can created by the lifting back of a tab is about one-half of an inch, the cooling substance 90 cannot enter through the top of the can. If the cooling substance 90 comprises a plurality of ice cubes, and the ice cubes begin to melt, thereby reducing the size of the ice cubes, there is the possibility that the water from the melted cubes will enter the can. At this time the semi-melted cubes can be replaced with fresh ice cubes, a block of ice or another cooling substance 90. If the beverage-holding device is a bottle, the opening is again relatively small, preventing the ice cubes from entering the bottle and diluting the beverage contained therein.

The user may insert a straw through the ice cubes and into the small opening in the top of the can or bottle. The user can then suck the beverage through the straw. The beverage, contained within the straw, is cooled as it passes through the cooling substance 90 and into the user's mouth. The sanitary beverage cooler 10 can be used without the use of a straw by having the user tilt the disposable beverage cooler 10 allowing the beverage to flow out of the beverage-holding container 100, through the cooling substance 90 and into the user's mouth.

With or without the use of a straw, the sanitary beverage cooler 10 retains the cooling substance 90 in its receptacle 20 thereby preventing the cooling substance 90 from making contact with the beverage within the beverage-holding container 100, thus eliminating the possibility of the beverage becoming diluted.

The sanitary beverage cooler 10 of the present invention can be formed of inexpensive disposable material such as plastic or a plastic-like material.

I claim:

1. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding can; and means to affix said receptacle to said open end of said beverage-holding can;

wherein said sanitary beverage cooler is disposable.

2. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding can; and means to affix said receptacle to said open end of said beverage-holding can, said affixing means comprising a protruding lip projecting circularly inward from said inner side of said affixing end wherein said lip is in continuous abutting engagement with the open end of said beverage-holder can;

wherein said sanitary beverage cooler is disposable.

3. A sanitary beverage cooler comprising:

a cylindrical receptacle defining an orfice for retaining a cooling substance comprising of a plurality of ice cubes wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding can; and means to affix said receptacle to said open end of said beverage-holding can;

wherein said sanitary beverage cooler is disposable.

4. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding can, said first diameter being greater then said second diameter thereby increasing size of said orfice to allow for greater amount of said cooling substance to be retained within said receptacle; and means to affix said receptacle to said open end of said beverage-holding can;

wherein said sanitary beverage cooler is disposable.

5. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture and said affixing end defines a second aperture, said first and said second apertures having a diameter of sufficient dimensions to affix to an open end of a beverage-holding can; and means to affix said receptacle to an open end of a beverage-holding can;

wherein said sanitary beverage cooler is disposable.

6. A sanitary beverage cooler comprising:

a plastic cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding can; and means to affix said receptacle to an open end of a beverage-holding can;

wherein said sanitary beverage cooler is disposable.

7. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding bottle; and means to affix said receptacle to said open end of said beverage-holding bottle;

wherein said sanitary beverage cooler is disposable.

8. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding bottle; and means to affix said receptacle to an open end of a beverage-holding container, said affixing means comprising a protruding lip projecting circularly inward from said inner side of said affixing end wherein said lip is in continuous abutting engagement with the open end of said beverage-holder bottle;

wherein said sanitary beverage cooler is disposable.

9. A sanitary beverage cooler comprising:

a cylindrical receptacle defining an orfice for retaining a cooling substance comprising of a plurality of ice cubes wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding bottle, said first diameter being greater then said second diameter thereby increasing size of said orfice to allow for greater amount of said cooling substance to be retained within said receptacle; and means to affix said receptacle to said open end of said beverage-holding bottle;

wherein said sanitary beverage cooler is disposable.

10. A sanitary beverage cooler comprising:

a cylindrical receptacle defining an orfice for retaining a cooling substance wherein said receptacle has a first end, an affixing end, a middle portion, and inner and outer sides, wherein said first end defines a first aperture and said affixing end defines a second aperture, said first and said second apertures having a diameter of sufficient dimensions to affix to an open end of a beverage-holding bottle; and means to affix said receptacle to said open end of said beverage-holding bottle;

wherein said sanitary beverage cooler is disposable.

11. A sanitary beverage cooler comprising:

a plastic cylindrical receptacle defining an orfice for retaining a cooling substance wherein said receptacle has a first end, an affixing end, a middle portion, and inner and outer sides, wherein said first end defines a first aperture having a first diameter and said affixing end defines a second aperture having a second diameter of sufficient dimensions to affix to an open end of a beverage-holding bottle; and means to affix said receptacle to an open end of a beverage-holding bottle;

wherein said sanitary beverage cooler is disposable.

* * * * *